US011044546B1

(12) United States Patent
Graham

(10) Patent No.: US 11,044,546 B1
(45) Date of Patent: Jun. 22, 2021

(54) MODE CONTROLLED ACOUSTIC LEAK MECHANISM TO OPTIMIZE AUDIO PERFORMANCE

(71) Applicant: Plantronics, Inc., Santa Cruz, CA (US)

(72) Inventor: John S Graham, Scotts Valley, CA (US)

(73) Assignee: Plantronics, Inc., Santa Cruz, CA (US)

( * ) Notice: Subject to any disclaimer, the term of this patent is extended or adjusted under 35 U.S.C. 154(b) by 0 days.

(21) Appl. No.: 16/911,178

(22) Filed: Jun. 24, 2020

(51) Int. Cl.
*H04R 1/10* (2006.01)
*G10L 25/78* (2013.01)

(52) U.S. Cl.
CPC ..... *H04R 1/1041* (2013.01); *G10L 25/78* (2013.01); *H04R 1/1016* (2013.01)

(58) Field of Classification Search
CPC ..... H04R 1/1041; H04R 1/1016; G10L 25/78
See application file for complete search history.

(56) References Cited

U.S. PATENT DOCUMENTS

2016/0330537 A1* 11/2016 Barrentine ..... G10K 11/17881
2017/0195771 A1* 7/2017 Hung ..... H04R 1/10
2017/0303027 A1* 10/2017 Barry ..... F04B 45/045
2019/0356991 A1* 11/2019 Farver ..... H04R 25/602
2020/0213731 A1* 7/2020 Miller ..... H04R 3/005

* cited by examiner

*Primary Examiner* — Simon King
(74) *Attorney, Agent, or Firm* — Chuang Intellectual Property Law

(57) ABSTRACT

Methods and apparatuses for earphones are disclosed. In one example, an earphone includes a speaker arranged to output an audible sound to an earphone user ear. The earphone includes an earphone housing having a first earphone housing opening arranged to output the audible sound into an ear canal of the earphone user. The earphone housing further includes a second earphone housing opening arranged to port to an ambient air ear exterior when the earphone is inserted into the earphone user ear. The earphone includes a valve positioned between the first earphone housing opening and the second earphone housing opening. The valve is operated in an open position during a telephony mode to provide an acoustic leakage pathway between the first earphone housing opening and the second earphone housing opening. The valve is operated in a closed position during a media mode to close the acoustic leakage pathway.

20 Claims, 5 Drawing Sheets

MODE CONTROLLED ACOUSTIC LEAK MECHANISM TO OPTIMIZE AUDIO PERFORMANCE

BACKGROUND OF THE INVENTION

Earphones are the preferred interface by many users to listen to music or watch multimedia video when using a variety of electronic devices such as smartphones, tablet computers, or laptop computers. Users are increasingly choosing earbud or in-ear style (e.g., intra-canal) earphones which have a highly occluded ear interface and are designed to fit within and form a seal with the user's ear canal. The sealed cavity allows for improved low-frequency response, thereby providing improved bass response when listening to music, and allows for maximum sound output into the ear canal. These earphones provide very good sound quality while simultaneously providing a small and lightweight profile.

However, the inventor has recognized that the highly occluded interface design is undesirable in certain situations and limits the use of the earphones. As a result, there is a need for improved methods and apparatuses for earphones.

BRIEF DESCRIPTION OF THE DRAWINGS

The present invention will be readily understood by the following detailed description in conjunction with the accompanying drawings, wherein like reference numerals designate like structural elements.

DESCRIPTION OF SPECIFIC EMBODIMENTS

Figure 1A:
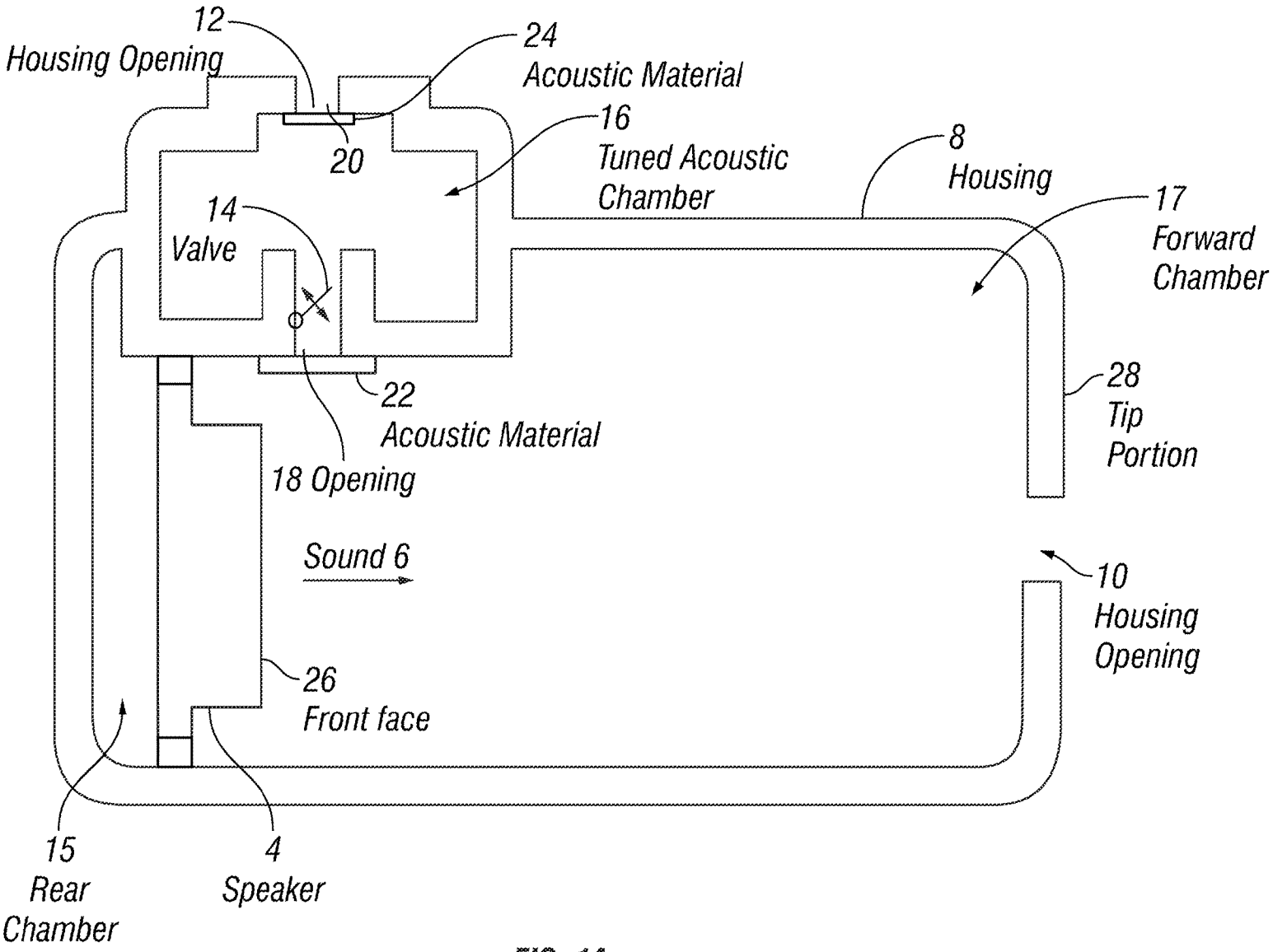
FIG. 1A is a schematic illustration of an earphone in one example configured to implement one or more of the examples described herein.

Methods and apparatuses for earphones are disclosed. The following description is presented to enable any person skilled in the art to make and use the invention. Descriptions of specific embodiments and applications are provided only as examples and various modifications will be readily apparent to those skilled in the art. The general principles defined herein may be applied to other embodiments and applications without departing from the spirit and scope of the invention. Thus, the present invention is to be accorded the widest scope encompassing numerous alternatives, modifications and equivalents consistent with the principles and features disclosed herein.

Block diagrams of example systems are illustrated and described for purposes of explanation. The functionality that is described as being performed by a single system component may be performed by multiple components. Similarly, a single component may be configured to perform functionality that is described as being performed by multiple components. For purpose of clarity, details relating to technical material that is known in the technical fields related to the invention have not been described in detail so as not to unnecessarily obscure the present invention. It is to be understood that various example of the invention, although different, are not necessarily mutually exclusive. Thus, a particular feature, characteristic, or structure described in one example embodiment may be included within other embodiments unless otherwise noted.

The inventor has recognized that earphones having highly occluded ear interfaces provide the best music performance, but have limited viability for use in telephony applications. The high occlusion of these earphones makes speaking uncomfortable due to loud low frequency resonances, creating a loud "booming" internalized sidetone effect. In one example of the invention, an automated acoustic leak is used to mitigate these low frequency resonances by allowing for a controlled leak when in a phone call, or at will. Methods and systems are described which use a digitally or electronically controlled acoustic valve that opens a leak into a designed acoustic pathway when a telephony (i.e., telecommunications) mode is detected, or if the user activates the feature.

By creating an acoustic leak, the loud low frequencies created in the ear canal and perceived by the user are alleviated. Also, while in this acoustic leak mode, receive and sidetone signals are optimized for the changed acoustic impedance and conditions. Advantageously, this solution provides improved sidetone audio comfort for users when they are speaking while on a phone call or at will while the earphone is occluding one or both ears. While speaking on a phone call, surrounding ambient audio is minimized while the acoustic leak alleviates low frequency resonances. Audio filters are optimized to account for the changed acoustic conditions when the acoustic leak is active so that the overall effect is transparent to the user.

Advantageously, the methods and systems described herein can be used in situations where a permanent leak is not possible due to a small speaker driver size and where the ear interface is highly occluding to support desired high receiver sensitivity at low frequencies when acoustics are optimized for music or multi-media applications. This is especially beneficial for small driver sizes, where high occlusion is needed for low frequency performance, but acoustic leak is needed to alleviate low frequency sidetone resonance when speaking.

In one example embodiment, an earphone includes a communications interface, a processor, and a speaker arranged to output an audible sound to an earphone user ear. The earphone includes an earphone housing having a first earphone housing opening arranged to output the audible sound into an ear canal of the earphone user. The earphone housing further includes a second earphone housing opening arranged to port to an ambient air ear exterior when the earphone is inserted into the earphone user ear.

The earphone includes a valve positioned between the first earphone housing opening and the second earphone housing opening. The valve is operated by the processor in an open position during a telephony mode to provide an acoustic leakage pathway between the first earphone housing opening and the second earphone housing opening. The valve is operated by the processor in a closed position during a media mode to close the acoustic leakage pathway between the first earphone housing opening and the second earphone housing opening.

In one example embodiment, a method for operating an earphone includes determining whether the earphone is being operated in a telephony mode or a media mode. The method includes transmitting a first control signal to a valve positioned in an earphone housing upon determination the earphone is in the telephony mode. The valve is actuated to open an acoustic leakage pathway responsive to the first control signal. The acoustic leakage pathway is between a first earphone housing opening arranged to output sound-waves into an interior of an earphone user ear and a second earphone housing opening arranged to port to an exterior of the earphone user ear when the earphone is inserted into the earphone user ear. The method further includes transmitting a second control signal to the valve upon determination the earphone is in the media mode. The valve is actuated to close the acoustic leakage pathway responsive to the second control signal.

Figure 1B:
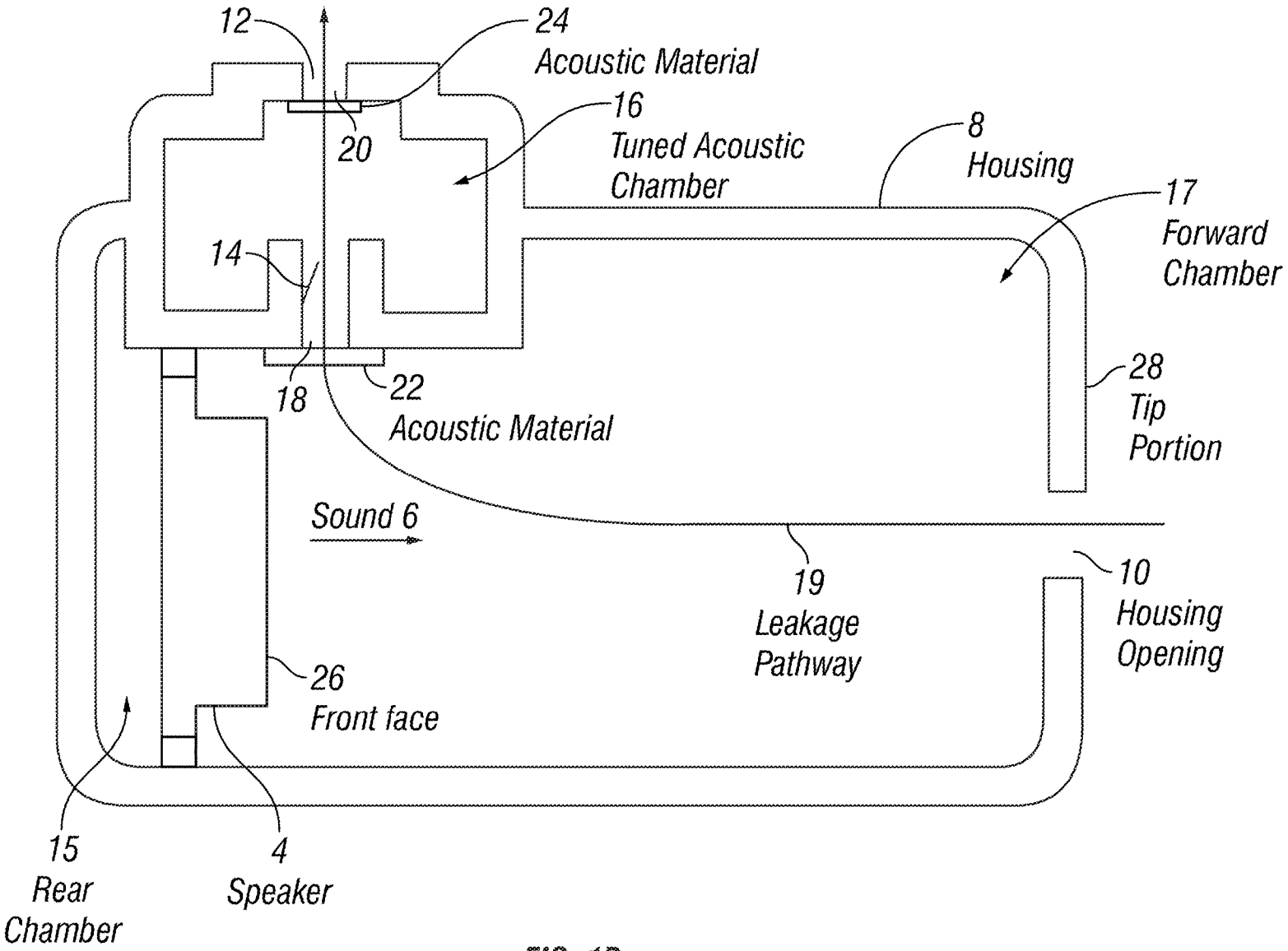
FIG. 1B is the earphone in FIG. 1A showing an acoustic leakage pathway.
Figure 2:
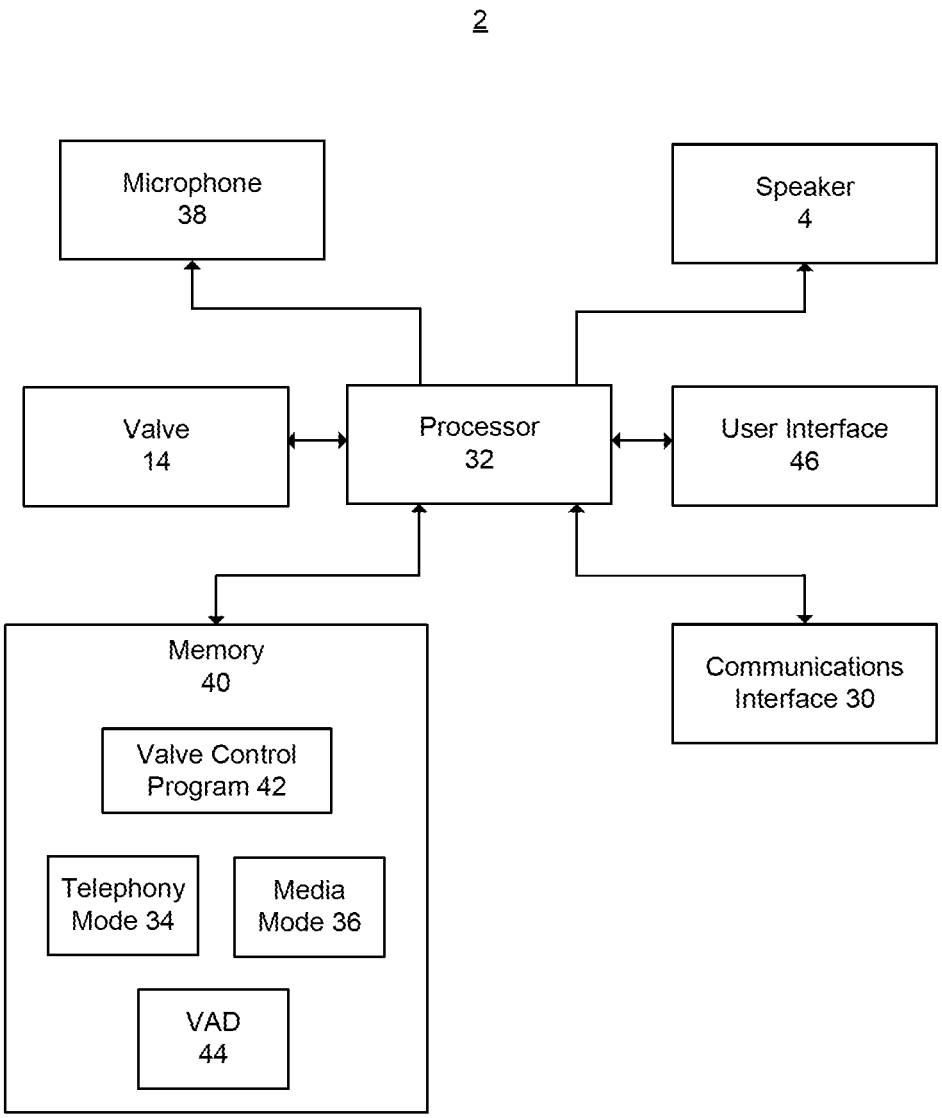
FIG. 2 illustrates a simplified block diagram of the earphone in FIG. 1A configured to implement one or more of the examples described herein.

FIG. 1A is a schematic illustration of an earphone 2 in one example configured to implement one or more of the examples described herein. The term "earphone" as used herein encompasses any ear-worn device operable as described herein. FIG. 1B is the earphone in FIG. 1A showing an acoustic leakage pathway 19. FIG. 2 illustrates a simplified block diagram of the earphone 2 in FIG. 1A in a telecommunications headset implementation example. Referring to FIG. 2, earphone 2 includes a communications interface 30, a processor 32, a memory 40, a user interface 46, and a speaker 4. Speaker 4 (also referred to as a receiver or driver) is arranged to output an audible sound 6 to an earphone user ear. In one implementation, earphone 2 is one of a matching pair, where earphone 2 is worn on the left or right ear and a corresponding earphone is worn on the opposite ear. For example, earphone 2 is worn on the user left ear to output a left channel of a stereo signal and a second earphone is worn on the user right ear to output a right channel of the stereo signal.

Referring to FIG. 1A, earphone 2 includes an earphone housing 8 dimensioned to rest in a concha of a user ear. Earphone housing 8 encloses a forward chamber 17 and includes a first earphone housing opening 10 arranged to output the audible sound 6 into an ear canal of the earphone user. A second earphone housing opening 12 is on a different side of earphone housing 8 from first earphone housing opening 10 (e.g., 90 degrees with respect to one another), whereby second earphone housing opening 12 is positioned to port to an ambient air ear exterior. Second earphone housing opening 12 is formed within a portion of earphone housing 8 that is not blocked by the ear when earphone 2 is resting in the user ear following insertion. Second earphone housing opening 12 may have any dimension, size, and shape suitable for achieving a desired acoustic performance of earphone 2. In one example, second earphone housing opening 12 is circular and has a diameter of between 0.5 mm and 3 mm. In further examples, second earphone housing opening 12 may be elliptical or rectangular. Speaker 4 has a front face 26 that outputs the audible sound 6 through forward chamber 17 and out the first earphone housing opening 10 into the user ear canal. Behind speaker 4 is a rear chamber 15. Speaker 4 is disposed within the earphone housing 8 and outside a tuned acoustic chamber 16.

Earphone 2 is designed to be inserted into and form a seal with the user's ear canal. A tip portion 28 is dimensioned to be inserted into an ear canal of a user. In one example, tip portion 28 may extend into the ear canal and contact the ear canal walls to form a seal. First earphone housing opening 10 is formed in the tip portion 28. In operation, first earphone housing opening 10 outputs sound produced by the speaker 4 into the ear canal. First earphone housing opening 10 may have any dimension, size, and shape suitable for achieving a desired acoustic performance of earphone 2. In further examples, tip portion 28 may have a tapered shape that tapers from a primary earphone body so that the end of tip portion 28 facing the ear canal has a reduced diameter or size relative to the primary earphone body and fits comfortably within the ear canal. In one implementation, tip portion 28 may be formed by a cap which is attached to earphone housing 8. Earphone 2, including tip portion 28 may be formed from a rigid plastic or similar material and may be molded into a desired shape and size as one integrally formed piece or as separate pieces. Any conventional molding process may be utilized.

Earphone 2 may be fitted with an ear tip (not illustrated) formed from a flexible and resilient rubber or silicone material attached at the tip portion 28 of earphone housing 8. The ear tip is configured to acoustically occlude an ear canal entrance when the tip portion 28 is inserted into the user ear, whereby the ear tip compresses against the ear canal wall and creates a sealed cavity that is effectively airtight. In one example, several sizes of ear tips (e.g., small, medium, and large) may be selected from by the user to provide a more personalized fit.

Forward chamber 17 provides a segment of an acoustic leakage pathway 19 (shown in FIG. 1B) for venting an acoustic pressure or air within the ear canal out second earphone housing opening 12. A valve 14 is positioned between the first earphone housing opening 10 and the second earphone housing opening 12. Valve 14 may be an actuated mechanical valve, cover, flap, disc, electro-restrictive material, or any other actuator means or suitable means for opening and closing the acoustic leakage pathway 19. Electrical or magnetic miniature drives may be employed, including rotating actuators. For example, valve 14 is positioned within a tubular channel in tuned acoustic chamber 16. In one example, the ratio of the length of the tubular channel to the diameter of housing opening 12 is no greater than 2 to 1 to minimize undesired resonances at higher frequencies. In further examples, other channel length to opening diameter ratios can be used to specifically tune to the anticipated valve-open resonance of a typical ear canal for the intended fit of the ear-tip design.

Valve 14 is operated by the processor 32 in an open position during a telephony mode to open the acoustic leakage pathway 19 between the first earphone housing opening 10 and the second earphone housing opening 12 through a forward chamber 17 and tuned acoustic chamber 16. Valve 14 is operated by the processor 32 in a closed position during a media mode to close the acoustic leakage pathway 19. Media mode may include operation where the user is listening to or watching multimedia, including listening to a music streaming application or watching a video streaming application. The acoustic leakage pathway 19 is tuned to reduce a low-frequency sidetone resonance utilizing an acoustic impedance when the acoustic leakage pathway 19 is open. The open acoustic leakage pathway 19 operates to ventilate the ear channel and reduce an occlusion effect.

Processor 32 is configured to transmit a first control signal to the valve 14 following determination the earphone 2 is in the telephony mode, wherein the valve 14 is opened responsive to the first control signal. Processor 32 is further configured to transmit a second control signal to the valve 14 following determination the earphone 2 is in the media mode, wherein the valve 14 is closed responsive to the second control signal.

Referring again to FIG. 1A, earphone housing 8 further includes a housing wall forming the tuned acoustic chamber 16, where the tuned acoustic chamber 16 is disposed along a length of the acoustic leakage pathway 19. Tuned acoustic chamber 16 includes a first tuned acoustic chamber opening 18 and a second tuned acoustic chamber opening 20. In this example, second tuned acoustic chamber opening 20 is the second earphone housing opening 12. In one example, valve 14 is disposed between the first tuned acoustic chamber opening 18 and the second tuned acoustic chamber opening 20. In further embodiments, more than one tuned acoustic chamber is utilized. For example, a tuned acoustic chamber may be utilized on both sides of valve 14. Each tuned acoustic chamber provides an acoustic impedance linked in series which may be tuned.

Tuned acoustic chamber 16 includes an acoustic tuning material configured to tune an acoustic response of the earphone 2 when the valve 14 is in the open position. For example, the acoustic tuning material is a first acoustic material 22 disposed over the first tuned acoustic chamber opening 18 and a second acoustic material 24 disposed over the second tuned acoustic chamber opening 20. First acoustic material 22 and second acoustic material 24 are an acoustically engineered material which provides an intentional and specified design acoustic resistance or filtering effect. In one example, first acoustic material 22 and second acoustic material 24 are formed from a mesh or foam material. First acoustic material 22 and second acoustic material 24 may be attached over their respective openings, first tuned acoustic chamber opening 18 and second tuned acoustic chamber opening 20, using an adhesive.

Second earphone housing opening 12 is formed in the tuned acoustic chamber 16. Tuned acoustic chamber 16, including second earphone housing opening 12, serves as a controlled acoustic leakage port to reduce the acoustic pressure within the ear, allowing a controlled amount of air to leak from the ear canal to the surrounding environment. Tuned acoustic chamber 16 is tuned (or calibrated) to modify an acoustic response of the earphone 2 to have a desired acoustic response both when valve 14 is in the open position and when valve 14 is in the closed position. Tuning of tuned acoustic chamber 16 may be performed by one or more of: (1) design of the size and shape of first tuned acoustic chamber opening 18, (2) design of the size and shape of second earphone housing opening 12 (e.g., second tuned acoustic chamber opening 20), (3) selection of first acoustic material 22, (4) selection of second acoustic material 24, and (5) design of the size and shape of the chamber interior volume. Tuned acoustic chamber 16 is tuned to achieve a given design specification, and may be tested or evaluated for compliance with such design specification. The use of valve 14 to control the amount of ear occlusion perceived by the user requires some control of the related acoustic impedances and Occlusion Reduction. Occlusion Reduction can be defined as reducing the perceived low frequency re-enforcement due to the occluded ear. The tuned acoustic chamber 16 is tuned to provide an acceptable audio pass-through that sufficiently allows for leakage into the concha and ear canal.

For example, tuned acoustic chamber 16 is tuned to provide sufficient air passage to accommodate frequencies as low as 70 Hz when valve 14 is open. Diameters of first tuned acoustic chamber opening 18 and second earphone housing opening 12 may range from 0.5 mm and 3 mm, though other port dimensions are possible to specifically tune to the anticipated valve-open resonance of a typical ear canal for the intended fit of the ear tip design.

In one example, tuned acoustic chamber 16 is tuned to support an acceptable sidetone response that rolls off between 350 Hz and 500 Hz. A generated sidetone is defined as an intended sidetone audio pathway provided by the earphone 2 during activation of the telephony audio system. Tuned acoustic chamber 16 is tuned to support some sub-sonic leakage below 30 Hz to 10 Hz, reducing these frequencies by up to 6 dB or more. When an audio pathway is not activated, the system may provide a leakage in the approximate 30 Hz to 350 Hz band to minimize "thumping" in the ear during movement, walking, etc. Leakage should provide at least 6 dB to 24 dB perceived occlusion reduction at the maximum point of the tuned response.

Tuning of the acoustic leakage pathway 19 is wide-band, with attention to lower frequencies. In one example, first acoustic material 22 and second acoustic material 24 are selected to control resonance "Q" so that broadband leakage can cover at up to 1.5 octaves centered within a range of approximately 70 Hz to 350 Hz. First acoustic material 22 and second acoustic material 24 may be located at or near the end of any opening (i.e., port) that is open to outside air, and may be located at either end of an acoustic short between a speaker back cavity and the forward chamber 17 side. First acoustic material 22 and second acoustic material 24 are tuned to allow for sufficient resistance to permit acceptable low frequency sensitivity from the intended speaker design.

Referring to FIG. 2, earphone 2 further includes a microphone 38 arranged to detect sound and provide a microphone output signal. In one example, processor 32 is configured to perform a voice activity detection utilizing the microphone output signal to identify a current voice of the earphone user. Processor 32 transmits an open control signal to the valve 14 upon determination of the current voice of the earphone user, wherein the valve 14 is opened responsive to the open control signal. In one example, the current voice of the earphone user occurs while the earphone 2 is in a non-telephony mode such as when the user is speaking in conversation face-to-face with someone. Processor 32 is further configured to identify a termination of the current voice of the earphone user utilizing the microphone output signal. Processor 32 transmits a close control signal to the valve 14 upon determination of the termination of the current voice, wherein the valve 14 is closed responsive to the close control signal.

In one example, the user may manually initiate opening and closing of the acoustic leakage pathway 19 using user interface 46. Processor 32 is configured to transmit an open control signal to the valve 14 following receiving an open user interface input at user interface 46, wherein the valve 14 is configured to open the acoustic leakage pathway 19 responsive to the open control signal. Processor 32 is configured to transmit a close control signal to the valve 14 following receiving a close user interface input at user interface 46, wherein the valve 14 is configured to close the acoustic leakage pathway 19 responsive to the close control signal.

The user interface 46 may include a multifunction power, volume, mute, and select button or buttons. Other user interfaces may be included on the earphone, such as a link active/end interface. It will be appreciated that numerous other configurations exist for the user interface.

Microphone 38 is coupled to an analog to digital (A/D) converter which forms a digitized signal from the analog signal output from the microphone 38. The digitized signal is received at processor 32. Microphone 38 may be part of a microphone array and include either omni-directional microphones, directional microphones, or a mix of omni-directional and directional microphones. In telephony mode, microphone 38 detects the voice of an earphone user which will be the primary component of the audio signal, and will also detect secondary components which may include background noise and the output of the earphone speaker 4. In one example, microphone 38 is integrated within earphone housing 8. In a further example, microphone 38 is installed at the lower end of a boom extending from earphone housing 8.

Processor 32 operates as a controller and may include one or more processors, memory and software to implement functionality as described herein. The processor 32 receives input from user interface 46 and manages audio data received from microphone 38 and audio from a far-end user sent to speaker 4. The processor 32 further interacts with communications interface 30 to transmit and receive signals between the earphone 2 and a computing device.

Memory 40 represents an article that is computer readable. For example, memory 40 may be any one or more of the following: random access memory (RAM), read only memory (ROM), flash memory, or any other type of article that includes a medium readable by processor 32. Memory 40 can store computer readable instructions for performing the execution of the various method embodiments of the present invention. Memory 40 includes a media mode application program 36 for operating earphone 2 in media mode and a telephony mode application program 34 for operating earphone 2 in telephony mode. Memory 40 includes a valve control program 42 for controlling operation of valve 14 (i.e., opening and closing) as described herein responsive to whether earphone 2 is operating in media mode or telephony mode.

Valve control program 42 may include various detection logic and control signal logic. Detection logic may be configured to detect occurrence of various types of events. Such events may include what type of audio signal is being received at earphone 2, including telephony audio, music (i.e., multimedia) audio, or an incoming ringtone. Such events may also include whether the user has activated a music player at a user device associated with earphone 2 or initiated a telephony call at such device. Such logic may also detect any real-time state change in the usage of earphone 2, including a state change from inactive use to music or telephony use, or a state change from music use to telephony use or vice-versa. In response to such detection logic, control signal logic sends control signals to open or close valve 14.

Memory 40 also includes a voice activity detection (VAD) application program 44 configured to process the microphone 38 output signal to determine when the user is speaking and when the user is silent. The output of the VAD application program 44, also known as a voicing decision, is binary. Operation of VAD application program 44 to detect speech is known to those of ordinary skill in the art and a variety of techniques, including sound level based techniques, may be used.

Figure 4:
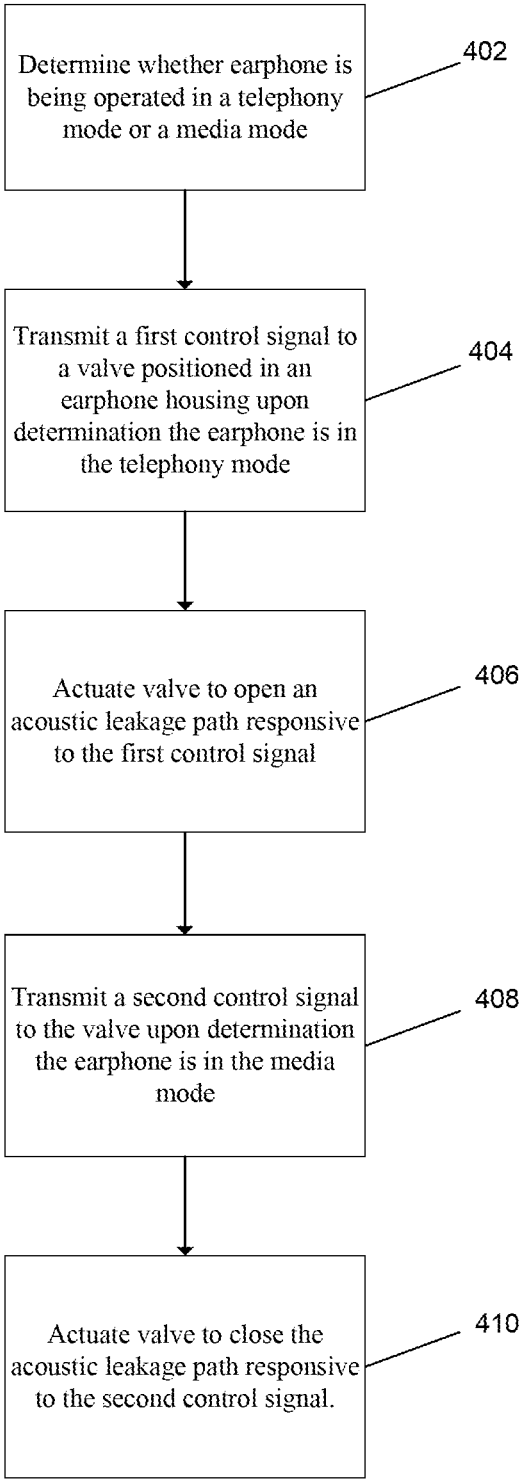
FIG. 4 is a flow diagram illustrating operation of an earphone in one example.

In one example, the processor executable computer readable instructions are configured to perform part or all of a process such as that shown in FIG. 4. Computer readable instructions may be loaded in memory 40 for execution by processor 32. Valve control program 42 interfaces with telephony mode application program 34, media mode application program 36, and voice activity detection application program 34. Although shown as separate blocks, the functionality performed by these programs may be integrated into one or more programs.

In one example, valve control program 42 interfaces with VAD application program 44 to open valve 14 only when the user speaks. For example, valve 14 is opened within 10 ms of detecting user speech to provide sidetone comfort. When VAD application program 44 detects cessation of user speech, valve control program 42 keeps valve 14 open between 30 ms and 120 ms prior to closure for better receive audio performance.

In a further example, earphone 2 may include additional operational modes. Where an operational mode requires speech by the earphone 2 user, valve control program 42 operates valve 14 in an open state similar to telephony mode. For example, earphone 2 may include a dictation mode or conversation mode (i.e., the earphone user is in face-to-face conversation with an adjacent person).

Communications interface 30 allows earphone 2 to communicate with other devices. Communications interface 30 may include a wired connection or a wireless connection. Communications interface 30 may include, but is not limited to, a wireless transceiver, an integrated network interface, a radio frequency transmitter/receiver, a USB connection, or other interfaces for connecting earphone 2 to a telecommunications network such as a Bluetooth network, cellular network, the PSTN, or an IP network. For example, communications interface 30 is a Bluetooth, Digital Enhanced Cordless Telecommunications (DECT), or IEEE 802.11 communications module configured to provide the wireless communication link. Bluetooth, DECT, or IEEE 802.11 communications modules include an antenna at both the receiving and transmitting end.

In a further example, the communications interface 30 may include a controller which controls one or more operations of the earphone 2. Communications interface 30 may be a chip module. The earphone 2 further includes a power source such as a rechargeable battery which provides power to the various components of the earphone 2.

In one example operation, processor 32 executes telephony mode application program 34 to perform telephony operations, including receiving, outputting, and transmitting audio associated with phone calls, including the voice of the earphone user and a far-end call participant. Processor 32 executes media mode application program 36 to perform media operations, including outputting audio associated with multimedia, such as music audio.

In one example operation, processor 32 executes telephony mode application program 34 to operate the earphone 2 in the telephony mode utilizing a first set of signal processing parameters and executes media mode application program 36 to operate the earphone 2 in the media mode utilizing a second set of signal processing parameters. The first set of signal processing parameters are configured to process sound corresponding to telephony voice communications between an earphone user and a voice call participant.

In one example, different audio profiles are utilized at earphone 2 to control the consistency of the sound quality when valve 14 is closed (e.g., media mode) and when valve 14 is opened (e.g., telephony mode). The different audio profiles include different equalization (EQ) profiles, noise reduction profiles, and sending audio profiles. The different EQ profiles may include separate sidetone EQ, receive (Rx) EQ, and send (Tx) EQ profiles. The different sending audio profiles may include separate sending sensitivity profiles and separate sending activation levels (non-linear processing). Furthermore, different active noise cancellation (ANC) tuning and filter profiles may be used when valve 14 is closed versus when it is open due to changes to the acoustic impedance.

In one example, the earphone 2 is further configured to switch between the telephony mode and the media mode responsive to an instruction received from a remote device. In a further application, the earphone 2 automatically determines which mode (telephony vs. media) to operate in based on monitored earphone activity, such as when the user receives an incoming call notification at the earphone 2 from a mobile phone.

Figure 3:
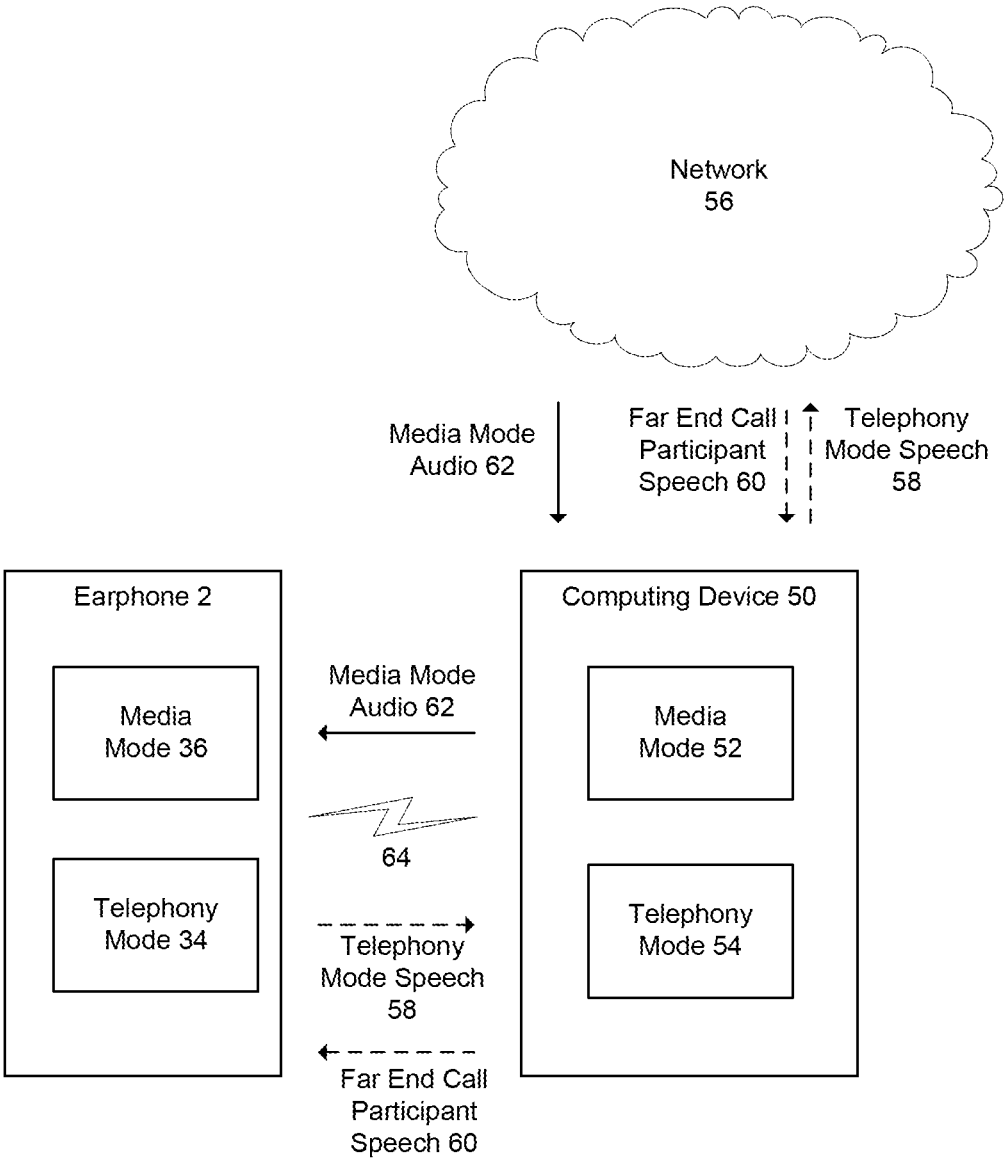
FIG. 3 illustrates an example implementation of the earphone shown in FIG. 1A used in conjunction with a computing device.

FIG. 3 illustrates an example implementation of the earphone 2 shown in FIG. 2 used in conjunction with a computing device 50. For example, computing device 50 may be a smartphone, tablet computer, or laptop computer. Earphone 2 is connectible to computing device 50 via a communications link 64. Although shown as a wireless link, communications link 64 may be a wired or wireless link. Computing device 50 is capable of wired or wireless communication with a network 56. For example, network 56 may be an IP network, cellular communications network, PSTN network, or any combination thereof.

In this example, computing device 50 executes a media mode application program 52 or telephony mode application program 54. In one example, media mode application program 52 may transmit a command to earphone 2 responsive to a user action at computing device 50, the command operating to instruct earphone 2 to enter media mode operation using media mode application program 36. For example, the user action at computing device 50 may be to select a music application or a video streaming application. Telephony mode application program 54 may transmit a command to earphone 2 responsive to a user action at computing device 50, the command operating to instruct earphone 2 to enter telephony mode operation using telephony mode application program 34. For example, the user action at computing device 50 may be to initiate a telephone call or answer an incoming call.

During media mode operation, media mode audio 62 is transmitted to earphone 2 from computing device 50. In one example, the media mode audio 62 is stored in a memory at computing device 50. In one example, media mode audio 62 is received at computing device 50 over network 56 from a media server, where the media mode audio 62 is then subsequently transmitted to earphone 2.

During telephony mode operation, an earphone user telephony mode speech 58 is transmitted to computing device 50 to be transmitted over network 56 to a telephony device coupled to network 56, such as a mobile phone used by a far end call participant. A far end call participant speech 60 is received at computing device 50 from network 56 and transmitted to earphone 2 for output at the earphone speaker 4.

In one example implementation of the system shown in FIG. 3, media mode application program 52 may include a music streaming application and/or video streaming application which may be selected by a user at a user interface of computing device 50. Responsive to the user selection of the music streaming application or video streaming application, media mode application program 52 sends an instruction to earphone 2 to execute media mode application program 36.

FIG. 4 is a flow diagram illustrating operation of a multi-mode earphone in one example. At block 402, it is determined whether the earphone is being operated in a telephony mode or a media mode.

At block 404, a first control signal is transmitted to a valve positioned in an earphone housing upon determination the earphone is in the telephony mode. At block 406, the valve is actuated to open an acoustic leakage pathway responsive to the first control signal. The acoustic leakage pathway is between a first earphone housing opening arranged to output soundwaves into an interior of an earphone user ear and a second earphone housing opening arranged to port to an exterior of the earphone user ear when the earphone is inserted into the earphone user ear. In one example, the acoustic leakage pathway is tuned to reduce a low-frequency sidetone resonance utilizing an acoustic impedance when the acoustic leakage pathway is open.

In one example, the earphone housing includes a housing wall forming a tuned acoustic chamber, the tuned acoustic chamber disposed along a length of the acoustic leakage pathway. The tuned acoustic chamber includes a first tuned acoustic chamber opening and a second tuned acoustic chamber opening. The valve is disposed between the first tuned acoustic chamber opening and the second tuned acoustic chamber opening. The tuned acoustic chamber includes an acoustic tuning material configured to tune an acoustic response of the earphone when the valve is in an open position. In one example, the acoustic tuning material includes a first acoustic material disposed over the first tuned acoustic chamber opening, and a second acoustic material disposed over the second tuned acoustic chamber opening.

At block 408, a second control signal is transmitted to the valve upon determination the earphone is in the media mode. At block 410, the valve is actuated to close the acoustic leakage pathway responsive to the second control signal.

In one example, operation of the multi-mode earphone further includes performing a voice activity detection utilizing a microphone output signal output from a microphone at the earphone to identify a current voice an earphone user. The voice activity detection may occur during a non-telephony mode. A third control signal is transmitted to the valve following determination of the current voice. The valve is actuated to open the acoustic leakage pathway responsive to the third control signal. A termination of the current voice of the earphone user utilizing the microphone output signal may be identified. A fourth control signal is transmitted to the valve upon identification of the termination of the current voice. The valve is actuated to close the acoustic leakage pathway responsive to the fourth control signal.

In one example, operation of the multi-mode earphone further includes transmitting a third control signal to the valve following receiving a first user interface input. The valve is actuated to open the acoustic leakage pathway responsive to the third control signal. A fourth control signal is transmitted to the valve following receiving a second user interface input. The valve is actuated to close the acoustic leakage pathway responsive to the fourth control signal.

While the exemplary embodiments of the present invention are described and illustrated herein, it will be appreciated that they are merely illustrative and that modifications can be made to these embodiments without departing from the spirit and scope of the invention. Certain examples described utilize headsets which are particularly advantageous for the reasons described herein. In further examples, other devices, such as other body worn devices may be used in place of headsets, including wrist-worn devices. Acts described herein may be computer readable and executable instructions that can be implemented by one or more processors and stored on a computer readable memory or articles. The computer readable and executable instructions may include, for example, application programs, program modules, routines and subroutines, a thread of execution, and the like. In some instances, not all acts may be required to be implemented in a methodology described herein.

Terms such as "component", "module", "circuit", and "system" are intended to encompass software, hardware, or a combination of software and hardware. For example, a system or component may be a process, a process executing on a processor, or a processor. Furthermore, a functionality, component or system may be localized on a single device or distributed across several devices. The described subject matter may be implemented as an apparatus, a method, or article of manufacture using standard programming or engineering techniques to produce software, firmware, hardware, or any combination thereof to control one or more computing devices.

Thus, the scope of the invention is intended to be defined only in terms of the following claims as may be amended, with each claim being expressly incorporated into this Description of Specific Embodiments as an embodiment of the invention.

What is claimed is:

1. An earphone comprising:

a communications interface;

a processor;

a speaker arranged to output an audible sound to an earphone user ear;

an earphone housing comprising a first earphone housing opening arranged to output the audible sound into an ear canal of an earphone user and a second earphone housing opening arranged to port to an ambient air ear exterior when the earphone is inserted into the earphone user ear; and a valve positioned between the first earphone housing opening and the second earphone housing opening, the valve operated by the processor in an open position during a telephony mode to provide an acoustic leakage path between the first earphone housing opening and the second earphone housing opening, and the valve operated by the processor in a closed position during a media mode to close the acoustic leakage path between the first earphone housing opening and the second earphone housing opening.

2. The earphone of claim 1, wherein the processor is configured to:

transmit a first control signal to the valve following determination the earphone is in the telephony mode, wherein the valve is opened responsive to the first control signal; and transmit a second control signal to the valve following determination the earphone is in the media mode, wherein the valve is closed responsive to the second control signal.

3. The earphone of claim 1, wherein the acoustic leakage path is tuned to reduce a low-frequency sidetone resonance utilizing an acoustic impedance when the acoustic leakage path is open.

4. The earphone of claim 1, wherein the earphone further comprises a microphone arranged to detect sound and provide a microphone output signal, and processor is further configured to:

perform a voice activity detection utilizing the microphone output signal to identify a current voice of the earphone user; and transmit a third control signal to the valve upon determination of the current voice of the earphone user, wherein the valve is opened responsive to the third control signal.

5. The earphone of claim 4, wherein the current voice of the earphone user occurs while the earphone is in a non-telephony mode.

6. The earphone of claim 4, wherein the processor is further configured to:

identify a termination of the current voice of the earphone user utilizing the microphone output signal; and transmit a fourth control signal to the valve upon determination of the termination of the current voice, wherein the valve is closed responsive to the fourth control signal.

7. The earphone of claim 1, wherein the earphone housing further comprises a housing wall forming a tuned acoustic chamber, the tuned acoustic chamber disposed along a length of the acoustic leakage path, the tuned acoustic chamber comprising:

a first tuned acoustic chamber opening;

a second tuned acoustic chamber opening comprising the second earphone housing opening, wherein the valve is disposed between the first tuned acoustic chamber opening and the second tuned acoustic chamber opening; and an acoustic tuning material configured to tune an acoustic response of the earphone when the valve is in the open position.

8. The earphone of claim 7, wherein the acoustic tuning material comprises:

a first acoustic material disposed over the first tuned acoustic chamber opening; and a second acoustic material disposed over the second tuned acoustic chamber opening.

9. The earphone of claim 7, wherein the speaker comprises a front face that outputs the audible sound in a direction towards the first earphone housing opening, and wherein the speaker is disposed within the earphone housing and outside the tuned acoustic chamber.

10. The earphone of claim 1, wherein the second earphone housing opening is circular and has a diameter of between 0.5 mm and 3 mm.

11. The earphone of claim 1, further comprising an ear tip comprising a flexible rubber material, the ear tip configured to acoustically occlude an ear canal entrance when the earphone is inserted into the earphone user ear.

12. The earphone of claim 1, wherein the processor is further configured to:

transmit a third control signal to the valve following receiving a first user interface input, wherein the valve is configured to open the acoustic leakage path responsive to the third control signal; and transmit a fourth control signal to the valve following receiving a second user interface input, wherein the valve is configured to close the acoustic leakage path responsive to the fourth control signal.

13. A method for operating an earphone comprising:

determining whether the earphone is being operated in a telephony mode or a media mode;

transmitting a first control signal to a valve positioned in an earphone housing upon determination the earphone is in the telephony mode;

actuating the valve to open an acoustic leakage path responsive to the first control signal, the acoustic leakage path between a first earphone housing opening arranged to output soundwaves into an interior of an earphone user ear and a second earphone housing opening arranged to port to an exterior of the earphone user ear when the earphone is inserted into the earphone user ear;

transmitting a second control signal to the valve upon determination the earphone is in the media mode; and actuating the valve to close the acoustic leakage path responsive to the second control signal.

14. The method of claim 13, wherein the acoustic leakage path is tuned to reduce a low-frequency sidetone resonance utilizing an acoustic impedance when the acoustic leakage path is open.

15. The method of claim 13, further comprising:

performing a voice activity detection utilizing a microphone output signal output from a microphone at the earphone to identify a current voice an earphone user; and transmitting a third control signal to the valve following determination of the current voice, wherein the valve is actuated to open the acoustic leakage path responsive to the third control signal.

16. The method of claim 15, wherein performing the voice activity detection utilizing the microphone output signal output from the microphone at the earphone to identify the current voice of the earphone user occurs during a non-telephony mode.

17. The method of claim 15, further comprising:

identifying a termination of the current voice of the earphone user utilizing the microphone output signal; and transmitting a fourth control signal to the valve upon identification of the termination of the current voice, wherein the valve is configured to close the acoustic leakage path responsive to the fourth control signal.

18. The method of claim 13, wherein the earphone housing comprises a housing wall forming a tuned acoustic chamber, the tuned acoustic chamber disposed along a length of the acoustic leakage path, the tuned acoustic chamber comprising:

a first tuned acoustic chamber opening;

a second tuned acoustic chamber opening, wherein the valve is disposed between the first tuned acoustic chamber opening and the second tuned acoustic chamber opening;

an acoustic tuning material configured to tune an acoustic response of the earphone when the valve is in an open position.

19. The method of claim 13, wherein the method further comprising:

transmitting a third control signal to the valve following receiving a first user interface input, wherein the valve is configured to open the acoustic leakage path responsive to the third control signal; and transmitting a fourth control signal to the valve following receiving a second user interface input, wherein the valve is configured to close the acoustic leakage path responsive to the fourth control signal.

20. One or more non-transitory computer-readable storage media having computer-executable instructions stored thereon which, when executed by one or more processors, cause the one or more processors to perform operations comprising:

determining whether a present mode of operation is one of a telephony mode or a media mode;

in response to determining the present mode of operation is the telephony mode, transmitting a first control signal to actuate a valve to open an acoustic leakage path; and in response to determining the present mode of operation is the media mode, transmitting a second control signal to the valve to close the acoustic leakage path.

* * * * *